US006755355B2

(12) United States Patent
Whittaker

(10) Patent No.: US 6,755,355 B2
(45) Date of Patent: Jun. 29, 2004

(54) COAL GASIFICATION FEED INJECTOR SHIELD WITH INTEGRAL CORROSION BARRIER

(75) Inventor: Gary Scott Whittaker, Kingsport, TN (US)

(73) Assignee: Eastman Chemical Company, Kingsport, TN (US)

( * ) Notice: Subject to any disclaimer, the term of this patent is extended or adjusted under 35 U.S.C. 154(b) by 15 days.

(21) Appl. No.: 10/125,211

(22) Filed: Apr. 18, 2002

(65) Prior Publication Data

US 2003/0197071 A1 Oct. 23, 2003

(51) Int. Cl.[7] ..... B05B 1/24

(52) U.S. Cl. ..... 239/132; 239/132.3; 239/397.5; 431/159

(58) Field of Search ..... 239/132, 132.1, 239/132.3, 397.5; 110/260, 261, 262, 263, 264, 265; 431/160, 181, 159, 187, 164, 166

(56) References Cited

U.S. PATENT DOCUMENTS

| | | | |
|---|---|---|---|
| 2,809,104 | A | 10/1957 | Strasser et al. |
| 4,353,712 | A | 10/1982 | Marion et al. |
| 4,502,633 | A | 3/1985 | Saxon |
| 4,518,348 | A | 5/1985 | Wedge et al. |
| 4,602,571 | A | 7/1986 | Chadshay |
| 4,685,882 | A | 8/1987 | Binasik et al. |
| 4,690,635 | A | 9/1987 | Coppin |
| 4,704,971 | A | 11/1987 | Fleischer et al. |
| 4,752,303 | A | 6/1988 | Materne et al. |
| 4,785,746 | A | 11/1988 | Roy et al. |
| 4,789,384 | A | 12/1988 | Martens et al. |
| 4,888,031 | A | 12/1989 | Martens |
| 4,889,670 | A | 12/1989 | Gurak et al. |
| 5,240,180 | A | 8/1993 | Feuillerat et al. |
| 5,261,602 | A | 11/1993 | Brent et al. |
| 5,273,212 | A | 12/1993 | Gerhardus et al. |
| 5,392,720 | A | 2/1995 | Briggs et al. |
| 5,511,725 | A | 4/1996 | Barker et al. |
| 5,515,794 | A | 5/1996 | Kassman et al. |
| 5,772,708 | A | 6/1998 | Froehlich |
| 5,904,477 | A | 5/1999 | Van Dam et al. |
| 5,934,206 | A | 8/1999 | Saxon et al. |
| 5,941,459 | A | 8/1999 | Brooker et al. |
| 5,947,716 | A | 9/1999 | Bellamy et al. |
| 5,954,491 | A | 9/1999 | Helton et al. |
| 6,010,330 | A | 1/2000 | Helton et al. |
| 6,123,542 | A | 9/2000 | Joshi et al. |
| 6,152,052 | A | 11/2000 | Saxon et al. |
| 6,228,224 | B1 | 5/2001 | Brooker |
| 6,276,924 | B1 | 8/2001 | Joshi et al. |
| 6,276,927 | B1 | 8/2001 | Lin |
| 6,358,041 | B1 | 3/2002 | Whittaker et al. |

FOREIGN PATENT DOCUMENTS

| | | |
|---|---|---|
| EP | 0 582 521 | 8/1993 |

OTHER PUBLICATIONS

Cao, et al., Microstructural Science, vol. 19, pp. 785–811.

*Primary Examiner*—Michael Mar
*Assistant Examiner*—Thach H Bui
(74) *Attorney, Agent, or Firm*—Jonathan D. Wood; Michael K. Carrier; Bernard J. Graves, Jr.

(57) ABSTRACT

A coal gasification nozzle is disclosed having a barrier, integral with the face of the injector, that fits into a groove of a heat shield attached to the nozzle face. The barrier prevents oxidative corrosion of the shield, and subsequent damage to the underlying face of the feed injector, by preventing diffusion of corrosive species to the threaded ring by which the heat shield is attached to the face of the nozzle. The life of the injector, and thus the length of any single gasification campaign, is thereby extended.

6 Claims, 3 Drawing Sheets

COAL GASIFICATION FEED INJECTOR SHIELD WITH INTEGRAL CORROSION BARRIER

FIELD OF THE INVENTION

The present invention relates generally to an improved feed injector nozzle, or burner, for use in a coal gasification apparatus for producing synthesis gas. The feed injector is provided with a threaded heat shield, to prevent corrosion of the feed injector face, and includes a barrier, integral with the face of the feed injector, that prevents the diffusion of corrosive species to the threaded attachment ring of the heat shield. This barrier prolongs the life of the heat shield by blocking the passage of corrosive species that cause the failure of the ring.

BACKGROUND OF THE INVENTION

Synthesis gas mixtures essentially comprising carbon monoxide and hydrogen are important commercially as a source of hydrogen for hydrogenation reactions, and as a source of feed gas for the synthesis of hydrocarbons, oxygen-containing organic compounds, and ammonia. One method of producing synthesis gas is by the gasification of coal, which involves the partial combustion of this sulfur-containing hydrocarbon fuel with oxygen-enriched air. In the slagging-type gasifier, a coal-water slurry and oxygen are used as fuel. These two streams are fed to the gasifier through a feed injector, sometimes called a burner, that is inserted in the top of the refractory-lined reaction chamber. The feed injector uses two oxygen and one coal slurry stream, all concentric, which are fed into the reaction chamber through a water-cooled head. The reaction chamber is operated at much higher pressure than the injector water jacket.

In this process, the reaction components are sprayed under significant pressure, such as about 80 bar, into the synthesis gas combustion chamber. A hot gas stream is produced in the combustion chamber at a temperature in the range of about 700° C. to about 2,500° C., and at a pressure in the range of about 1 to about 300 atmospheres, and more particularly, about 10 to about 100 atmospheres. The effluent raw gas stream from the gas generator typically includes hydrogen, carbon monoxide, and carbon dioxide, and can additionally include methane, hydrogen sulfide, and nitrogen, depending on fuel source and reaction conditions.

This partial combustion of sulfur-containing hydrocarbon fuels with oxygen-enriched air presents problems not normally encountered in the burner art. It is necessary, for example, to effect very rapid and complete mixing of the reactants, as well as to take special precautions to protect the burner or mixer from overheating. Because of the tendency for the oxygen and sulfur contaminants in coal to react with the metal from which a suitable burner may be fabricated, it is necessary to prevent the burner elements from reaching temperatures at which rapid oxidation and corrosion takes place. It is therefore essential that the reaction between the hydrocarbon and oxygen take place entirely outside the burner proper, and that the localized concentration of combustible mixtures at or near the surfaces of the burner elements be prevented.

Even though the reaction takes place beyond the point of discharge from the burner, the burner elements are subject to radiative heating from the combustion zone, and by turbulent recirculation of the burning gases. For these and other reasons, the burners are subject to failure due to metal corrosion about the burner tips, even though these elements are water-cooled, and though the reactants are premixed and ejected from the burner at rates of flow in excess of the rate of flame propagation. Typically, after a short period of operation, thermal corrosion fatigue cracks develop in the part of the jacket that faces the reaction chamber. Eventually these cracks penetrate the jacket allowing process gas to leak into the cooling water stream. When leaks occur, gasifier operation must be terminated to replace the feed injector.

Attempts have been made in the past, with varying levels of success, to minimize this problem. For example, U.S. Pat. No. 5,273,212 discloses a shielded burner clad with individual ceramic tiles, or platelets, arranged adjacent each other so as to cover the burner in the manner of a mosaic.

U.S. Pat. Nos. 5,934,206 and 6,152,052 describe multiple shield segments attached to the face of the feed injector by brazing. These shield segments are typically ceramic tiles, though other high melting point materials can also be used. Each of these tiles forms an angular segment of a tile annulus around the nozzle, the tiles being overlapped at the radial joints to form stepped, or scarfed, lap joints. The individual tiles are secured to the coolant jacket end face by a high temperature brazing compound.

U.S. Pat. No. 5,954,491 describes a wire-locked shield face for a burner nozzle. In this patent, a single piece ceramic heat shield is attached to the feed injector by passing high temperature alloy wires through the shield and a series of interlocking tabs. The shield is thus mechanically secured over the water jacket end-face of the injector nozzle, and is formed as an integral ring or annulus around the nozzle orifice.

U.S. Pat. No. 5,947,716 describes a breech lock heat shield face for a burner nozzle. The heat shield is comprised of an inner and an outer ring, each of which forms a full annulus about the nozzle axis, shielding only a radial portion of the entire water jacket face. The inner ring is mechanically secured to the metallic nozzle structure by meshing with lugs projecting from the external cone surface of the nozzle lip. The internal perimeter of the inner ring is formed with a channel having a number of cuts equal to the number of lugs provided, so as to receive the respective external lug element. When assembled, the inner ring is secured against rotation by a spot-welded rod of metal applied to the nozzle cooling jacket face within a notch in the outer perimeter of the inner ring.

The outer perimeter of the inner ring is formed with a step ledge, or lap, approximately half the total thickness of the ring, that overlaps a corresponding step ledge on the internal perimeter of the outer ring. The outer ring is also secured to the water jacket face by a set of external lug elements, projecting from the outer perimeter of the water jacket face. A cuff bracket around the perimeter of the outer ring provides a structural channel for receiving the outer set of water jacket lugs. The outer heat shield ring is also held in place by a tack-welded rod or bar.

U.S. Pat. No. 5,941,459 describes a fuel injector nozzle with an annular refractory insert interlocked with the nozzle at the downstream end, proximate the nozzle outlet. A recess formed in the downstream end of the fuel injector nozzle accommodates the annular refractory insert.

U.S. Pat. No. 6,010,330 describes a burner nozzle having a faired lip protuberance, a modification to the shape of the burner face that alters the flow of process gas in the vicinity of the face. This modification results in improved feed injector life. A smooth transition of recirculated gas flow across the nozzle face into the reactive material discharge column is believed to promote a static or laminar flowing boundary layer of cooled gas that insulates the nozzle face, to some extent, from the emissive heat of the combustion reaction.

U.S. Pat. No. 6,284,324 describes a coating that can be applied to the shields previously described, to thereby reduce high temperature corrosion of the shield material.

U.S. Pat. No. 6,358,041, the disclosure of which is incorporated herein by reference, describes a threaded heat shield for a burner nozzle face. The heat shield is attached to the feed injector by means of a threaded projection that engages a threaded recess machined in the back of the shield. The threaded projection can be a continuous member or a plurality of spaced-apart, individual members provided with at least one arcuate surface. This threaded method of attachment has been found to be a reliable way to attach the heat shield to the feed injector. It provides greater strength, and is more easily fabricated than other shield attachments. This is especially true when the shield is made of a metal that is easily machined.

Although the heat shield just described is a significant advance in the art, permitting extended operation times, the operational life is nonetheless limited by the corrosion that occurs at the center of the shield. Operating experience using the threaded attachment method has revealed that a local zone of high oxygen activity causes corrosion of the molybdenum shield. This local zone of high oxygen activity is caused by the gas flow dynamics of the oxygen stream as it exits the feed injector. An area of low pressure exists just outside the lip on the face of the injector. This low pressure zone draws in oxygen, causing corrosion of the molybdenum shield.

While molybdenum has extremely good resistance to corrosion by reducing gases, it is not so resistant to high temperature oxidation. As the shield corrodes, the protection it provides to the face of the injector is gradually lost, shortening the life of the injector. When this occurs, corrosion of both the back of the shield and the face of the injector results. This corrosion is particularly severe at the base of the threaded attachment ring that protrudes from the face of the injector. In some instances, the corrosion has even caused the thread ring to fail and the shield to depart.

Although the addition of a coated molybdenum shield to the face of the feed injector has doubled the maximum run length of the feed injector, the run length is still limited by oxidation of the shield which occurs near the center of the shield, leading to corrosion and cracking of the injector face. As the condition of the shield further deteriorates, more corrosive material accumulates between the shield and the injector face. This causes failure of the attachment ring, and eventual loss of the shield.

There remains a need to provide a heat shield and a burner for synthesis gas generation which are an improvement over the shortcomings of the prior art in terms of operational life expectancy, is simple in construction, and is economical in operation.

It is therefore an object of the invention to extend the operational life expectancy of the gas generation burner nozzle just described.

Another object of the invention is to provide a gas generation burner nozzle for synthesis gas generation having a reduced rate of corrosion.

A further object is to provide a burner nozzle heat shield to protect the metallic elements of the nozzle from the effects of corrosion caused by combustion gases.

Yet another object of the invention is to provide a ceramic insert that is specifically resistant to the effects of oxygen in removing the molybdenum from the oxidizing zone.

Yet a further object of the invention is to thereby protect the threads that attach the shield to the injector from the effects of corrosion caused by combustion gases.

SUMMARY OF THE INVENTION

These and other objects of the invention are attained by the present invention, which relates to a nozzle having a threaded heat shield, and having a barrier positioned between a faired lip protuberance of the nozzle and the threaded ring to which the shield is attached. The barrier is a dam, or protrusion, that is an integral part of the feed injector face, that seats against the heat shield at the base of a matching groove cut into the back face of the shield. The barrier prevents process gas from reaching the threaded ring, thereby prolonging the life of the heat shield, and of the nozzle.

DETAILED DESCRIPTION OF THE INVENTION

Figure 1:
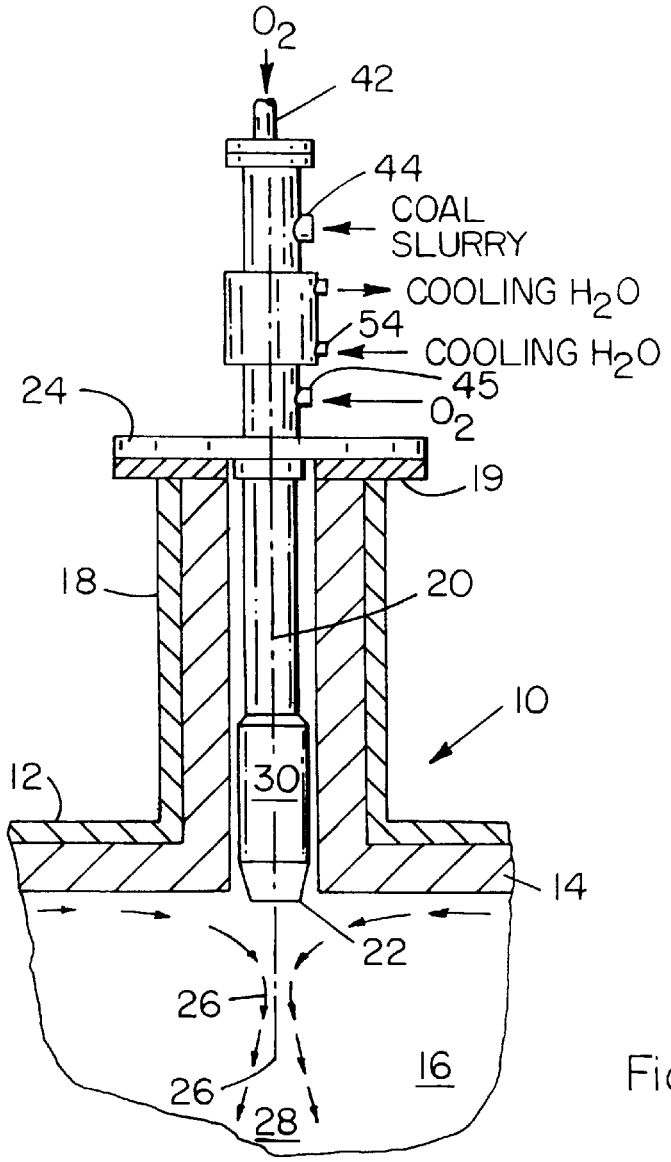
FIG. 1 is a partial sectional view of a synthesis gas generation combustion chamber and burner.

Referring now to FIG. 1, a partial cut-away view of a synthesis gas generation vessel 10 is illustrated. The vessel 10 includes a structural shell 12 and an internal refractory liner 14 around an enclosed combustion chamber 16. Projecting outwardly from the shell wall is a burner mounting neck 18 that supports an elongated fuel injection burner assembly 20 within the reactor vessel. The burner assembly 20 is aligned and positioned so that the face 22 of the burner is approximately flush with the inner surface of the refractory liner 14. A burner mounting flange 24 secures the burner assembly 20 to a mounting neck flange 19 of the vessel 10 to prevent the burner assembly 20 from becoming ejected during operation.

Figure 2:
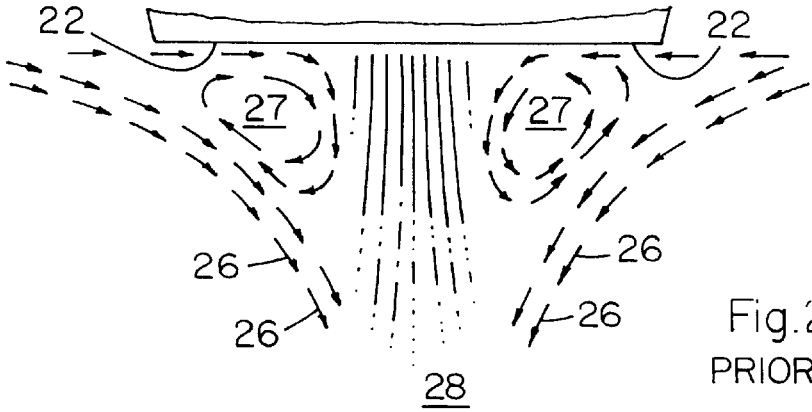
Fig.2 PRIOR ART
FIG. 2 is a detail of the combustion chamber gas dynamics at the burner nozzle face.

Although not wishing to be bound by any theory, it is believed that FIGS. 1 and 2 represent a portion of the internal gas circulation pattern within the combustion chamber. The gas flow depicted as arrows 26 is driven by the high temperature and combustion conditions within the combustion chamber 16. Depending on the fuel and induced reaction rate, temperatures along the reactor core 28 may reach as high as 2,500° C. As the reaction gas cools toward the end of the synthesis gas generation chamber 16, most of the gas is drawn into a quench chamber similar to that of the synthesis gas process described in U.S. Pat. No. 2,809,104, which is incorporated herein by reference. However, a minor percentage of the gas spreads radially from the core 28 to cool against the reaction chamber enclosure walls. The recirculation gas layer is pushed upward to the top center of the reaction chamber where it is drawn into the turbulent downflow of the combustion column. With respect to the model depicted in FIG. 2, at the confluence of the recirculation gas with the high velocity core 28, a toroidal eddy flow 27 is believed to be produced, that turbulently scrubs the burner head face 22, thereby enhancing the opportunity for chemical reactivity between the burner head face material and the highly reactive, corrosive compounds carried in the combustion product recirculation stream.

Figure 3:
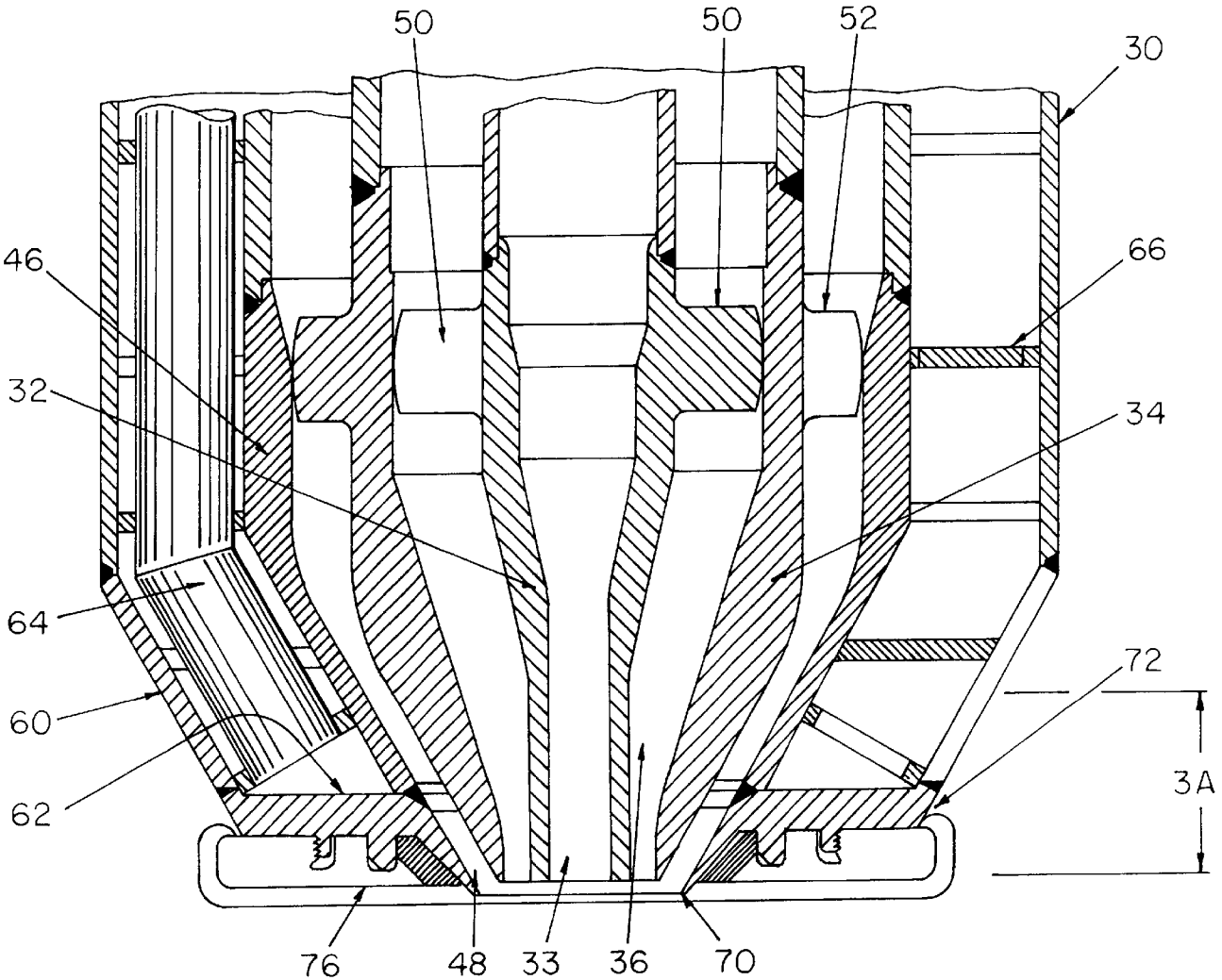
FIG. 3 is a partial sectional view of a synthesizing gas burner nozzle constructed according to a preferred embodiment of the invention.

Referring to FIGS. 1 and 3, the burner assembly 20 includes an injector nozzle assembly 30 comprising three concentric nozzle shells and an outer cooling water jacket 60. The inner nozzle shell 32 discharges the oxidizer gas that is delivered along upper assembly axis conduit 42 from axial bore opening 33. Intermediate nozzle shell 34 guides the coal slurry delivered to the upper assembly port 44 into the combustion chamber 16. As a fluidized solid, this coal slurry is extruded from the annular space 36 defined by the inner nozzle shell wall 32 and the intermediate nozzle shell wall 34. The outer, oxidizer gas nozzle shell 46 surrounds the outer nozzle discharge annulus 48. The upper assembly port 45 supplies the outer nozzle discharge annulus 48 with an additional stream of oxidizing gas.

Centralizing fins 50 and 52 extend laterally from the outer surface of the inner and intermediate nozzle shell walls 32 and 34, respectively, to keep their respective shells coaxially centered relative to the longitudinal axis of the burner assembly 20. The structure of the fins 50 and 52 form discontinuous bands about the inner and intermediate shells, thus offering little resistance to the fluid flow within the respective annular spaces.

As described in greater detail in U.S. Pat. No. 4,502,633, the entire disclosure of which is incorporated herein by reference, the inner nozzle shell 32 and the intermediate nozzle shell 34 are both axially adjustable relative to the outer nozzle shell 46 for the purpose of flow capacity variation. As intermediate nozzle 34 is axially displaced from the conically tapered internal surface of outer nozzle 46, the outer discharge annulus 48 is enlarged to permit a greater oxygen gas flow. Similarly, as the outer tapered surface of the internal nozzle 32 is axially drawn toward the internally conical surface of the intermediate nozzle 34, the coal slurry discharge area is reduced.

Surrounding the outer nozzle shell 46 is a coolant fluid jacket 60 having an annular end closure 62. A coolant fluid conduit 64 delivers a coolant, such as water, from the upper assembly supply port 54 directly to the inside surface of the end closure plate 62. Flow channeling baffles 66 control the path of coolant flow around the outer nozzle shell, to assure a substantially uniform heat extraction, and to prevent the coolant from channeling and producing localized hot spots. The end closure 62 includes a nozzle lip 70, such as that described in U.S. Pat. No. 6,010,330, which is incorporated by reference herein, that defines generally an exit orifice or discharge opening for the feeding of reaction materials into the injection burner assembly 20.

Figure 3A:
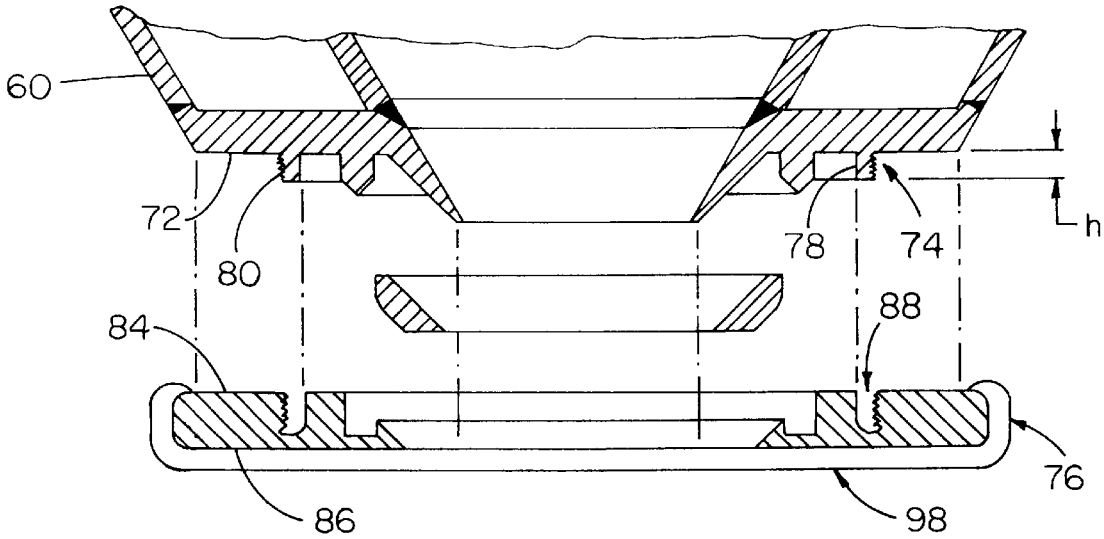
FIG. 3A is an enlarged, exploded cross-sectional view of a portion of FIG. 3 taken along axis 3A.
Figure 3B:
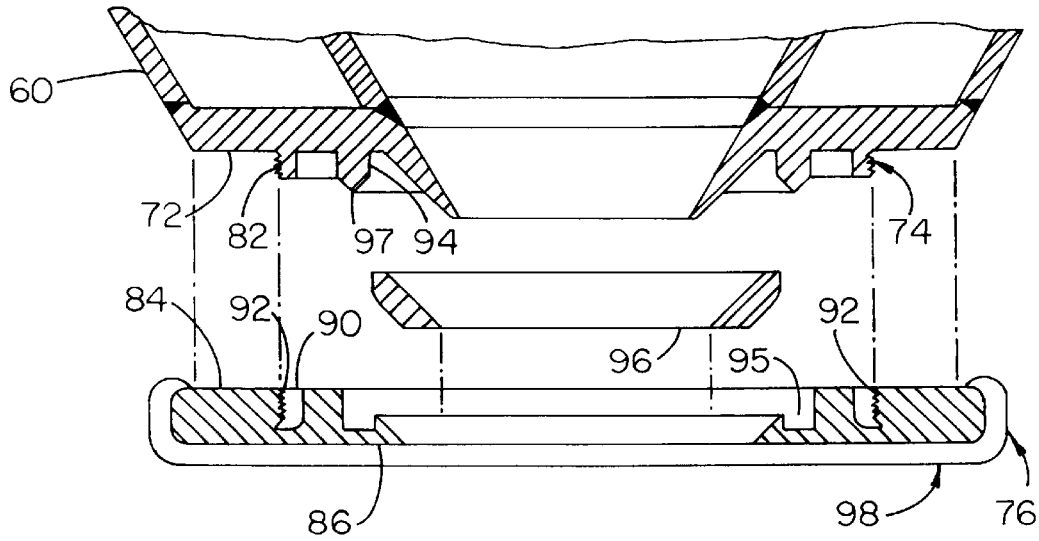
FIG. 3B is a duplicate of the enlarged, exploded cross-sectional view of FIG. 3A, provided so as to clearly label further features according to the invention.

Referring now to FIGS. 3, 3A and 3B, the planar end of the cooling jacket 62 includes an annular surface forming the injector face 72, which is disposed facing the combustion chamber 16. Typically, the annular surface 72 forming the injector face 72 of the cooling jacket 62 is comprised of a cobalt base metal alloy material, such as alloy 188, designed for use at elevated temperatures in both oxidizing and sulfidizing environments. Alloy 188 includes chromium, lanthanum, and silicon, provided to enhance corrosion resistance; and tungsten, to improve strength at elevated temperatures. Other cobalt base alloys such as alloy 25 or alloy 556 might also be advantageously used. One problem with this type of material is that when high sulfur coal is used, the sulfur compounds that are present in the coal tend to react with the cobalt base metal alloy materials, causing corrosion. A self-consumptive corrosion is sustained, that ultimately terminates with failure of the burner assembly 20. Although cobalt is generally the preferred material of construction for the nozzle assembly 30, other high temperature melting point alloys, such as alloys of molybdenum or tantalum, may also be used.

Projecting from the annular surface 72 is a threaded projection 74 for affixing a heat shield 76 to the burner nozzle injector assembly 30. The heat shield 76 can be constructed from one of several high temperature materials, including ceramics, cermets and refractory metals such as molybdenum, tantalum or niobium that are suitable for use in a reducing gasification environment. The heat shield 76 typically is comprised of molybdenum.

The threaded projection 74 can be integral to the injector face 72; i.e., the threaded projection can be machined from a solid metal piece comprising the annular surface forming the injector face 72. Alternatively, the retaining means can be a separate member secured to the injector face 72, in which case the projection 74 can be affixed to the injector face 72 using methods known to those skilled in the art, such as by welding, screwing on, brazing, and the like. The threaded projection 74 extending from the injector face 72 can be a continuous member, such as a ring, or a plurality of spaced-apart, individual members, each of which may be cylindrical or crescent-shaped. The threaded projection 74 includes an inner surface 78 and an outer surface 80, either or both of which may be threaded. FIG. 3B depicts threads 82 provided on the outer surface 80 of the threaded projection 74. An annular channel 88 is provided in an upper surface 84 of the heat shield 76. The annular channel 88 is threaded on at least one of an inner surface 90 and an outer surface 92 of the annular channel 88, and is adapted to receive the threaded projection 74.

Also projecting from the annular surface forming the injector face 72, and interior to the threaded projection 74 with respect to the axial bore opening 33, is an annular barrier 94, or dam, that is integral with the injector face 72. This annular barrier 94 is a ring-shaped projection provided on the face of the injector 72 between the conical projection that forms the inside diameter opening and the threaded projection 74 to which the shield is attached. The annular barrier 94 is received by an annular groove 95 which is provided in the upper surface 84 of the heat shield. At least a portion 97, or perhaps a face, of the annular barrier 94 is in contact with the bottom of the groove 95 that is cut in the upper surface 84 of the heat shield 76 to accommodate the projection. The purpose of this annular projection/groove arrangement is to create a barrier to the passage of corrosive species, thus serving as a labyrinth seal, to thereby prevent corrosion and failure of the threaded attachment of the shield.

Interior to the barrier 94, with respect to the axial bore opening 33, is provided an annular, or conical, oxidation-resistant insert 96. This oxidation-resistant insert 96 is the subject of a copending patent application, assigned to the present assignee, filed on the same date as the present application. The oxidation-resistant insert 96 is positioned so as to functionally replace the portion of the heat shield that is most likely to be lost to corrosion. The oxidation-resistant insert 96 is separate from the shield, conical in shape, and held in place by the heat shield 76. The insert is typically fabricated from an oxidation-resistant ceramic that is machinable.

The oxidation-resistant insert 96 is accommodated by increasing the diameter of the center hole of the shield, by removing a conically shaped portion of the shield. The oxidation-resistant insert 96 is typically a ceramic, and is positioned by being placed over the nozzle lip 70 on the face of the feed injector 72, typically comprised of alloy 188. The heat shield 76 is then screwed into place on the injector face 72 in the usual manner, thus holding the insert in place. The design provides a small amount of clearance between the insert 96, the annular surface of the injector face 72, and the heat shield 76, to prevent cracking of the brittle ceramic. When assembled in this fashion, the insert occupies the oxidation zone, and the heat shield 76, typically comprising molybdenum, is subjected primarily to reducing conditions, thereby preventing corrosion of the shield and the injector face 72 that is covered by the insert.

The heat shield 76 is formed from a high temperature melting point material such as silicon nitride, silicon carbide, zirconia, molybdenum, tungsten or tantalum. Representative proprietary materials include the Zirconia TZP and Zirconia ZDY products of the Coors Corp. of Golden, Colo. Characteristically, these high temperature materials tolerate temperatures up to about 1,400° C., include a high coefficient of expansion, and remain substantially inert within a high temperature, highly reducing/sulfidizing environment. Preferably, the heat shield contains molybdenum.

The heat shield 76 can include a high temperature, corrosion-resistant coating 98, such as that described in U.S. Pat. No. 6,284,324, which is incorporated herein by reference. The coating 98 is applied to the lower surface 86 of the heat shield 76 facing the combustion chamber, to a thickness of from about 0.002 to about 0.020 of an inch (0.05 mm to about 0.508 mm), and especially from about 0.005 to about 0.015 of an inch (0.127 to about 0.381 mm). To assist in the application of the coating 98 to the heat shield 76, a portion of the heat shield proximate the nozzle lip 70 can have a small radius of from about 0.001 inch to about 0.50 inch (0.0254 mm to about 12.7 mm).

The coating 98 is an alloy having the general formula of MCrAlY, wherein M is selected from iron, nickel or cobalt. The coating composition can include from about 5–40 weight % Cr, 0.8–35 weight % Al, up to about 1 weight % of the rare earth element yttrium, and 15–25 weight % Co with the balance containing Ni, Si, Ta, Hf, Pt, Rh and mixtures thereof as an alloying ingredient. A preferred alloy includes from about 20–40 weight % Co, 5–35 weight % Cr, 5–10 weight % Ta, 0.8–10 weight % Al, 0.5–0.8 weight % Y, 1–5 weight % Si and 5–15 weight % $Al_2O_3$. Such a coating is available from Praxair and others.

The coating 98 can be applied to the lower surface 86 of the heat shield 76 using various methods known to those skilled in the powder coating art. For example, the coating can be applied as a fine powder by a plasma spray process. The particular method of applying the coating material is not particularly critical as long as a dense, uniform, continuous adherent coating is achieved. Other coating deposition techniques such as sputtering or electron beam may also be employed.

Having described the invention in detail, those skilled in the art will appreciate that modifications may be made to the various aspects of the invention without departing from the scope and spirit of the invention disclosed and described herein. It is, therefore, not intended that the scope of the invention be limited to the specific embodiments illustrated and described, but rather, it is intended that the scope of the present invention be determined by the appended claims and their equivalents.

We claim:

1. A feed injector for injecting a fluidized fuel and an oxidizing material into a high temperature combustion chamber, the feed injector comprising:

an injector nozzle, defining an axial bore opening, and comprised of at least two concentric nozzle shells and an outer cooling jacket, the outer cooling jacket defining a substantially planar annular end face and an annular nozzle lip;

at least one threaded projection, extending from the end face;

a substantially planar heat shield, having an upper surface, a lower surface, and an inner surface, the inner surface defining a center hole;

an annular threaded channel, on the upper surface of the heat shield, adapted to rotatably receive the at least one threaded projection, to thereby affix the heat shield to the end face of the injector nozzle;

an annular barrier, extending from the end face of the injector nozzle, positioned interior to the at least one threaded projection with respect to the axial bore opening; and an annular groove, provided in the upper surface of the heat shield, adapted to receive the annular barrier.

2. The feed injector according to claim 1, wherein the annular barrier is provided with a lower portion thereof, and the annular groove is provided with a bottom portion, and wherein the lower portion of the annular barrier contacts the bottom portion of the annular groove when the heat shield is affixed to the end face of the injector nozzle.

3. The feed injector according to claim 1, wherein the threaded projection comprises a ring having an inner surface and an outer surface, at least one of which inner and outer surfaces is threaded.

4. The feed injector according to claim 1, wherein the at least one threaded projection comprises a plurality of threaded projections.

5. The feed injector according to claim 1, wherein the heat shield comprises a material having a high coefficient of thermal conductivity.

6. The feed injector according to claim 5, wherein the material having a high coefficient of thermal conductivity is at least one member selected from the group consisting of silicon nitride, silicon carbide, a zirconia-based ceramic, molybdenum, tungsten, and tantalum.

* * * * *